United States Patent [19]

Mountz et al.

[11] 4,380,300

[45] Apr. 19, 1983

[54] AIR CARGO CONTAINER

[75] Inventors: Elton E. Mountz, Morgantown; Paul H. Martin, East Earl, both of Pa.

[73] Assignee: Morgan Trailer Mfg. Co., Morgantown, Pa.

[21] Appl. No.: 289,407

[22] Filed: Aug. 3, 1981

Related U.S. Application Data

[63] Continuation of Ser. No. 122,139, Feb. 19, 1980, abandoned.

[51] Int. Cl.[3] ..... B65D 25/00

[52] U.S. Cl. ..... 220/1.5; 206/598

[58] Field of Search ..... 220/1.5; 206/595, 598, 206/386; 108/57.1

[56] References Cited

U.S. PATENT DOCUMENTS

| | | | |
|---|---|---|---|
| 2,297,347 | 9/1942 | Cruickshank | 108/57.1 |
| 2,640,669 | 6/1953 | Ashford | 52/588 |
| 2,664,219 | 12/1953 | Schmidt | 220/1.5 |
| 2,823,883 | 2/1958 | Bourdon | 108/57.1 |
| 2,910,016 | 10/1959 | Faverty | 105/422 |
| 2,956,699 | 10/1960 | Payne | 254/45 |
| 3,061,134 | 10/1962 | Fesmire | 220/1.5 |
| 3,260,223 | 7/1966 | Black et al. | 220/1.5 |
| 3,306,487 | 2/1967 | Gregoire | 220/1.5 |
| 4,046,278 | 9/1977 | Chieger et al. | 220/1.5 |
| 4,292,899 | 10/1981 | Steffen | 108/57.1 |

FOREIGN PATENT DOCUMENTS

| | | | |
|---|---|---|---|
| 514515 | 7/1955 | Canada | 296/182 |

*Primary Examiner*—Steven M. Pollard
*Assistant Examiner*—D. Voorhees
*Attorney, Agent, or Firm*—Z. T. Wobensmith, 2nd; Z. T. Wobensmith, III

[57] ABSTRACT

An air cargo container is disclosed of metallic construction which is light in weight, yet sturdy and which has structure for overcoming problems which have been encountered with cargo containers heretofore available and with particular reference to hold-down or restraint pockets, fork lift pockets and floor construction and which complies with present government and other applicable standards.

5 Claims, 8 Drawing Figures

AIR CARGO CONTAINER

CROSS REFERENCE TO RELATED APPLICATION

This is a continuation of application Ser. No. 122,139, filed Feb. 19, 1980.

BACKGROUND OF THE INVENTION

1. Field of the Invention

This invention relates to air cargo containers and more particularly to structure which avoids problems which have herefore arisen.

2. Description of the Prior Art

Various containers have heretofore been proposed specifically for moving cargo by air transport or which are capable of use for such purposes. Among these are the following U.S. Patents, Combs et al., No. 3,044,656; Tantlinger, No. 3,085,707; Russell-French, No. 3,647,100; Carr, No. 3,834,575; Barnes et al., No. 3,968,895; Meller et al., No. 4,008,936; and Dougherty, No. 4,057,170.

In cargo containers, also, it has been proposed to provide hold-down or restraint pockets along the lower side rails of the container for engagement by hold-down or restraint levers pivotally mounted on vertical axes carried on the floor in the cargo space of the plane, as shown by Tantlinger, U.S. Pat. No. 3,085,707. Pedraza, in U.S. Pat. No. 3,955,700, shows slots 30 with inserted fingers 29 for which no purpose is stated but which with the fingers 29 removed could serve for that purpose.

Repeated use of the container results in damage to the vertical side walls of the pockets, at the entrance and no satisfactory provisions have heretofore been made for quick or easy repair at the damaged locations.

It has also been common practice to provide spaced fork lift pockets along the side rails of the containers. Examples are to be found in U.S. Patents as follows: Bertolini et al., No. 3,004,682; Fesmire, No. 3,015,407; Fesmire et al., No. 3,061,134; Morrison et al., No. 3,561,633; Dougherty, No. 3,910,446; Barnes et al., No. 3,968,895; and Clive-Smith, No. 4,162,737. The British Pat. No. 1,343,899 to Ministerium fur Verkehrswesen, shows but does not identify such pockets and Australian Pat. No. 238,796, to Holyman shows such a fork lift pocket with side guides for fork introduction. Fesmire et al., No. 3,061,134 show top and side guides for fork introduction.

Serious difficulties have been encountered by reason of careless fork lift truck operators penetrating the side walls of containers and the like or approaching fork lift pockets at an angle.

Repeated use of the containers heretofore available also results in wear along the vertical side walls of the fork lift pockets. No satisfactory provisions have heretofore been made for protecting the side walls of the containers or for quick and easy repair at the entrance to the fork lift pocket.

The patents heretofore referred to show various floor constructions but do not suggest the multiple layer flat bottom lower floor for an air cargo container of the present invention and in which the planking of the upper floor extends uninterrupted for its entire length and is interlocked to resist side loads.

SUMMARY OF THE INVENTION

In accordance with the present invention an air cargo container is provided which is light in weight, sturdy, and which overcomes problems which have arisen with the cargo containers heretofore available and with specific reference to hold-down or restraint pockets, fork lift pockets and floor construction which satisfy present governmental and other applicable standards, and which are intermodal for types of air cargo planes including the 747 and DC10.

It is the principal object of the present invention to provide an air cargo container which is light in weight and which has safeguards against problems encountered with air cargo containers heretofore available.

It is a further object of the present invention to provide an air cargo container with provisions for easy replacement of parts which are subject to wear and other damage.

It is a further object of the invention to provide an air cargo container having a hold-down pocket with provisions for easy replacement of parts subject to wear.

It is a further object of the present invention to provide a fork lift pocket with greater protection than has heretofore been available and with provisions for easy replacement of parts subject to damage or wear.

It is a further object of the invention to provide an air cargo container with an improved floor construction with lower and upper sections and in which lower and outer section provides an exterior flat bottom which is capable of sustaining a high uniformly distributed load, and which will withstand the effects of rollers or other objects thereunder.

It is a further object of the invention to provide an air cargo container with an improved floor construction with lower and upper sections and in which the upper and inner floor section comprises planks uninterruptedly extending the full length of the floor and in which the planks are interlocked to resist side loads.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 1:
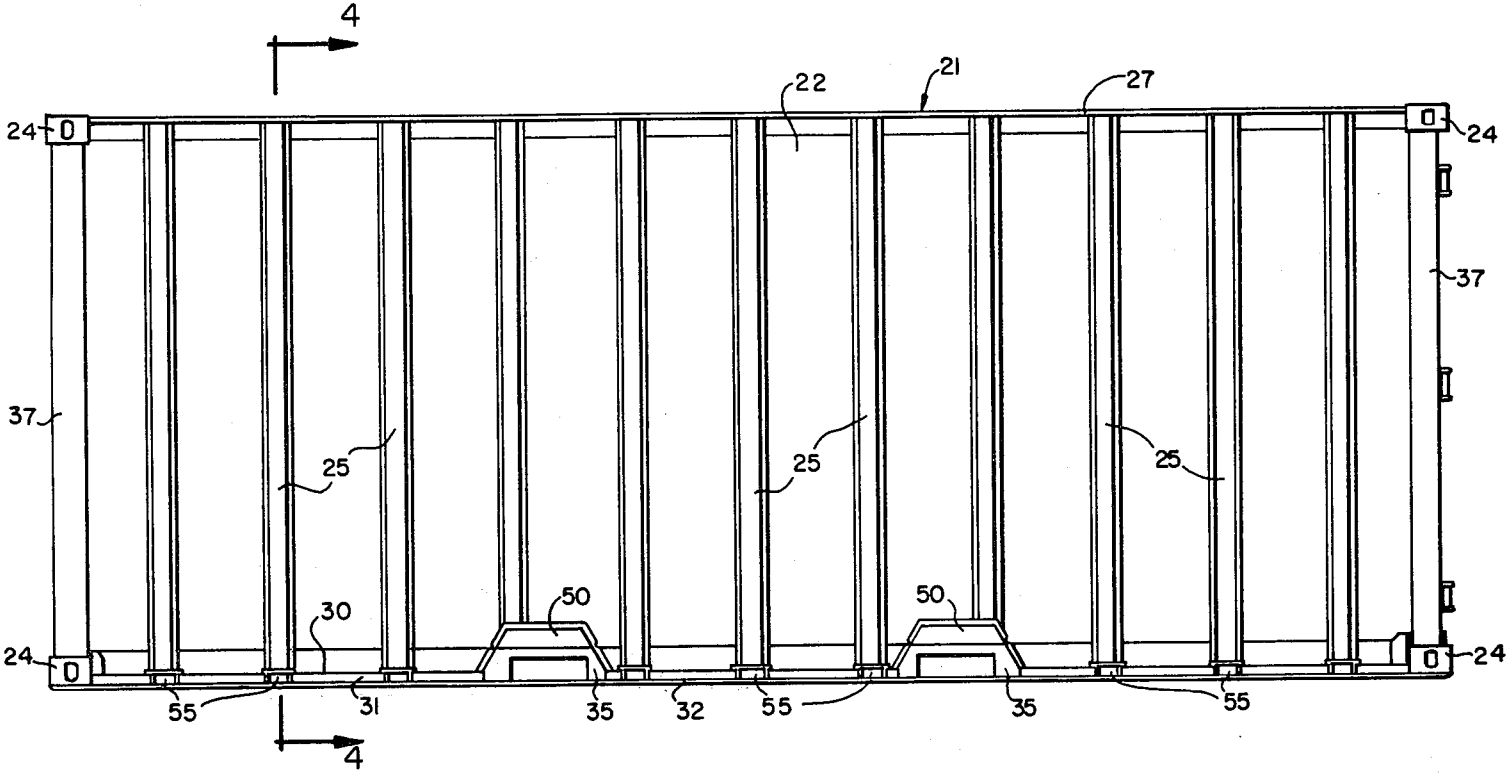
FIG. 1 is a side elevation of an air cargo container in accordance with the invention.
Figure 3:
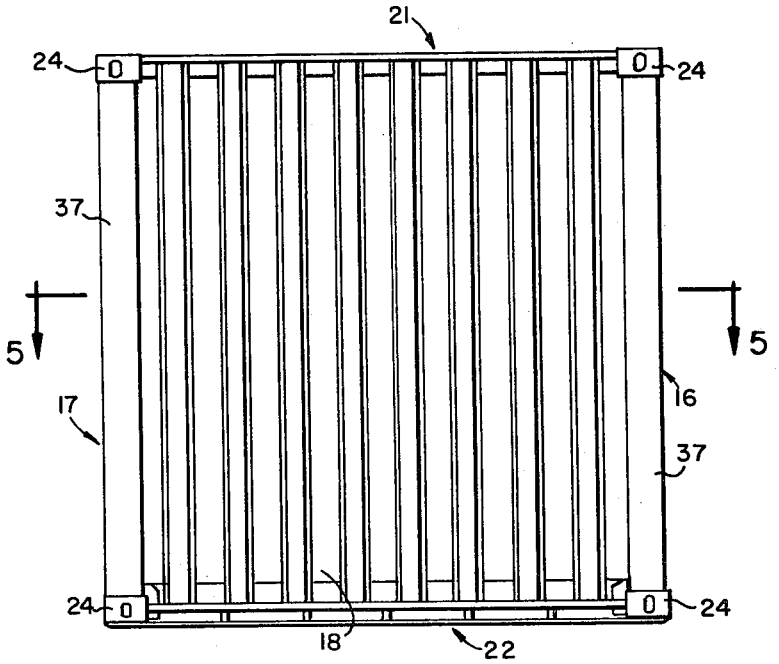
FIG. 3 is a front elevation of the air cargo container of FIG. 1.
Figure 2:
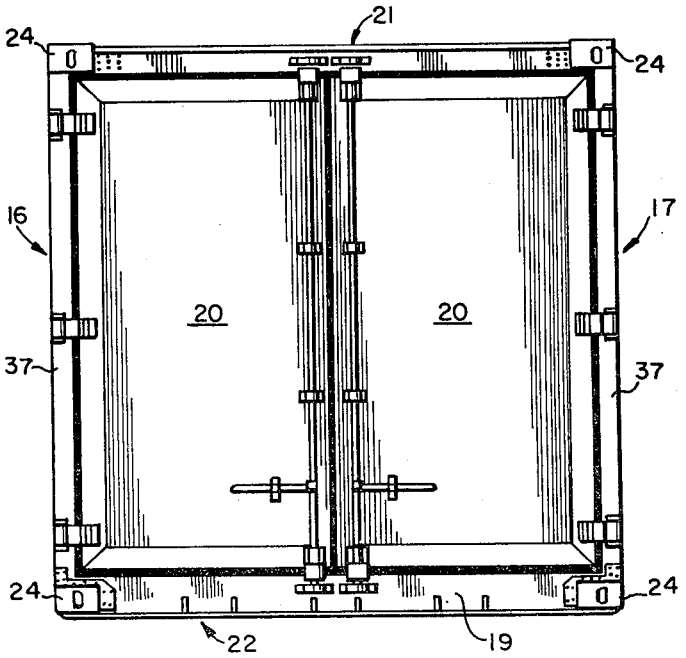
FIG. 2 is a rear elevation of the air cargo container of FIG. 1.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF A PREFERRED EMBODIMENT

Referring now more particularly to the drawings the air cargo container in accordance with the invention is shown of generally rectilinear shape and includes opposite side walls 16 and 17 of similar construction, a front wall 18, a rear wall 19 with closure doors 20, a top wall 21 and a composite bottom wall 22.

The construction is essentially of aluminum extrusions and aluminum sheets with corner blocks, and certain other parts of aluminum which are heat treated for hardening. Cast corner blocks 24 of well known type can be employed at the upper and lower corners secured in place in any desired manner. The side walls 16 and 17 each has a plurality of "hat shaped" vertical posts 25 preferably formed as aluminum extrusions extending upwardly and secured at their top ends by brackets 26 to longitudinal extruded top side rails 27 of inverted L-shape and with outer downwardly extending rails **27*a* engaging the posts 25 and to transverse hat shaped top extruded beams 28 preferably by welding, riveting or in any other desired manner. The top transverse extruded beams 28 and the top longitudinal extruded top side rail 27 are preferably of aluminum and covered by a sheet 29, preferably of aluminum, secured thereto in any desired manner. A liner 23 of sheet metal extends along and is secured to the interior faces of the wall posts 25**.

The bottom ends of the vertical posts 25 other than as noted, are secured to a horizontal box plate 30 which has an integral downwardly extending rub rail or box plate 31 both secured to a longitudinal bottom side rail 32 which is interrupted on each side by two fork lift pockets shown generally at 33.

Each of the fork lift pockets 33 includes a channel 34 extending transversely between the side walls 16 and 17 with a ribbed floor section 36 secured along its margins to the lower edges of the channel 34. The fork lift pockets 33 each has a lower casting 35 which is of hardened material such as heat treated aluminum welded to the bottom side rail 32, and the box plates 30 and 31 and the outwardly horizontally extending flange of the bottom rail 32 from which the vertical portion has been removed for horizontal access of the fork lift.

The casting 35 has a beveled access opening 36 along its side and top edges to guide the fork inwardly.

Within the casting 35 and carried on the horizontally extending flange of the bottom rail 32 an inverted U-shaped bracket 38 is provided removably secured to L-shaped brackets 39 by flat headed bolts 40 and held by nuts 41. The L-shaped brackets 39 are secured to the horizontal flange of the bottom side rail 32 by pop rivets 42. Each of the brackets 38 has secured thereon, and on each side of the entrance to the pocket 33 a stainless steel block 43 which is resistant to the wear attendant upon the insertion and removal of the fork lift.

The lower casting 35 along the inside of its upper edge has a plurality of locating and securing tabs 44.

An upper casting 50 also of heat treated aluminum is mounted on the casting 35 with an opening 51 for the wall post 25 at this location, the post 25 extending downwardly to the top of the casting 35.

The upper casting 50 is secured to the lower casting 35 by pop rivets 51 extending through the casting 50, and the tabs 44, by pop rivets 52 to the post 25 and by pop rivets 53 to the liner 23. The upper casting 50 can be readily removed for access to the bracket 38 by drilling out the pop rivets 51, 52, and 53.

It will be noted that the exterior faces of the castings 35 and 50 present a large protected area which prevents damage to or penetration of the side walls 16 and 17.

Figures 6, 7, 8:
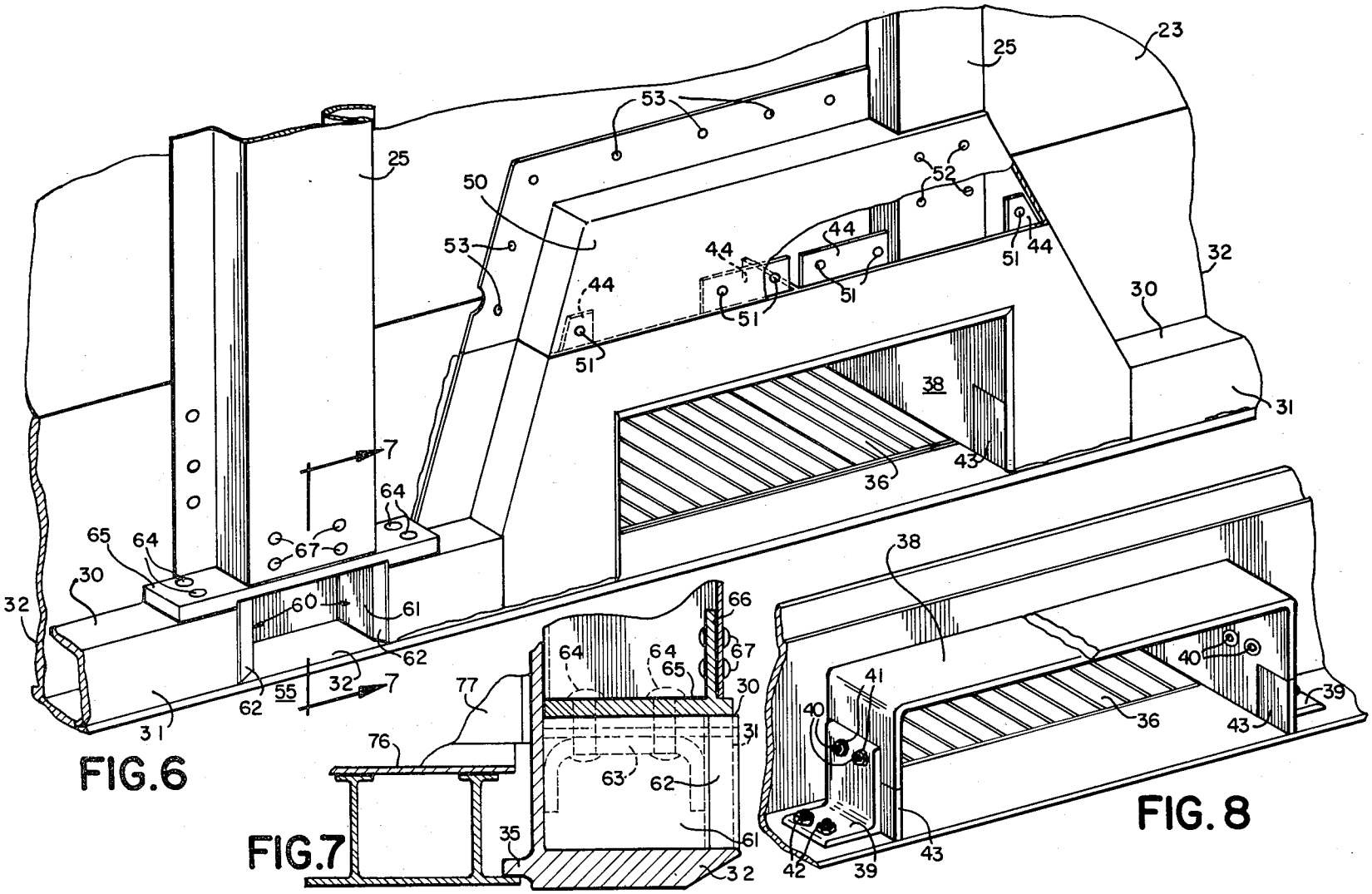
FIG. 6 is a view in perspective of the hold-down pocket and a contiguous fork lift pocket.
FIG. 7 is a vertical section view taken approximately on the line 7—7 of FIG. 6.
FIG. 8 is a fragmentary view in perspective of the fork lift pocket prior to installation of the protective castings, and showing interior details of construction.

The side walls 16 and 17 along their lower portions are provided with a plurality of hold-down or restraint pockets 55, shown in detail in FIGS. 6 and 7, these being located at the lower ends of side wall posts 25.

The pockets 55 are bounded at the bottom by the horizontal flanges of the bottom side rails 32 and at their inner ends by the vertical flanges of the bottom side rails 32. At each side of the pockets 55 insert castings 60 are provided, having body portion 61 inserted within the space bounded by the box plates 30 and 31, and the flanges of the bottom side rails 32.

These insert castings 60 are of material resistant to impact and wear, and can be of hardened aluminum or other suitable material. The insert castings 60 each has an exposed plate portion 62, and a rounded entrance edge or corner 63.

In order to retain the insert castings 60 in place a retainer plate 65 is provided carried on the box plates 30 and extending in overlapping relation thereto and to the body portions 61 of the insert castings 60 and with pop rivets 64 through the plate 65 and body portions 61. The retainer plate 65 has a lug 66 extending upwardly within the post 25 with pop rivets 67 through the post 25 and lug 66.

Figure 4:
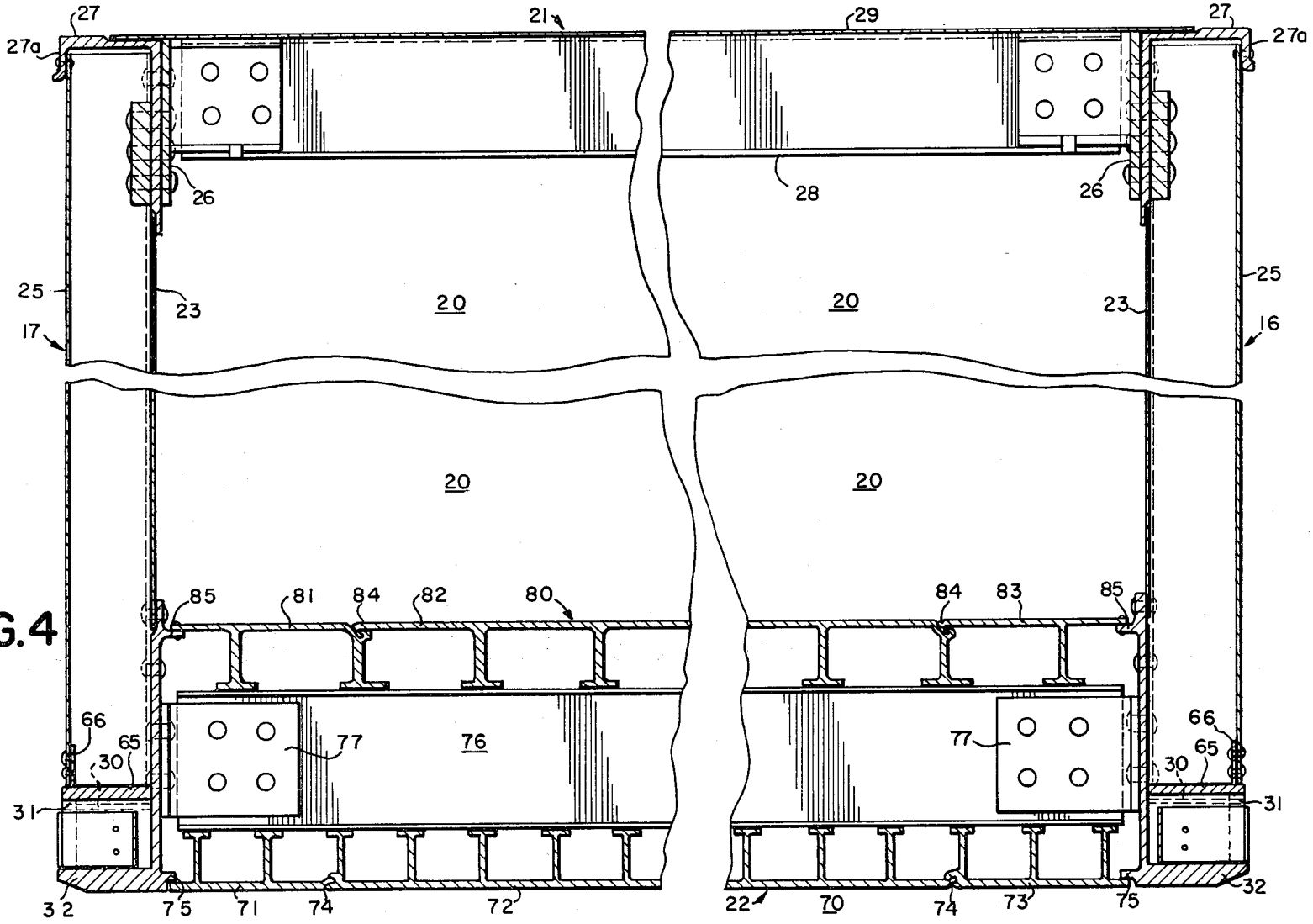
FIG. 4 is a vertical sectional view, enlarged, taken approximately on the line 4—4 of FIG. 1.
Figure 5:
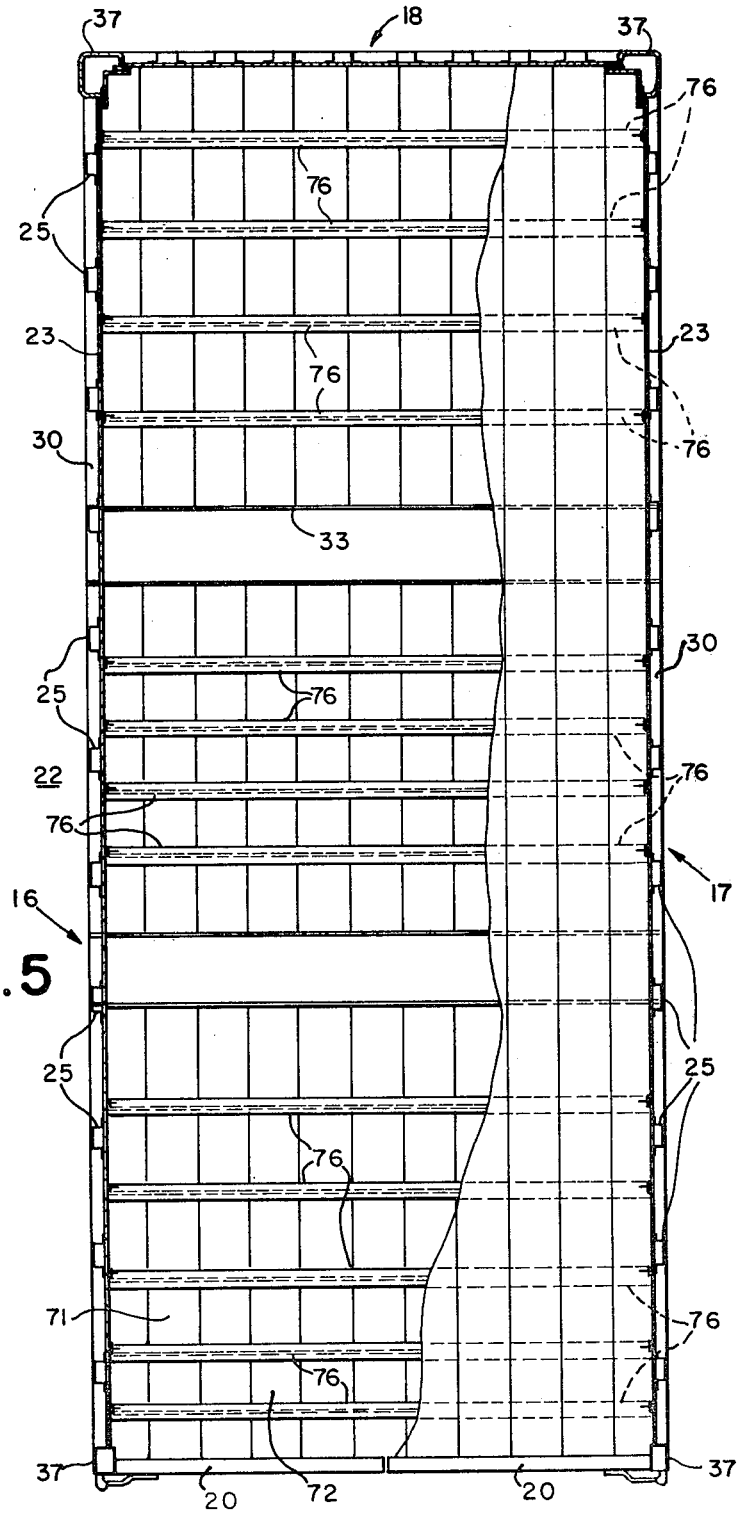
FIG. 5 is a horizontal sectional view taken approximately on the line 5—5 of FIG. 3, with part of the upper or inner floor section being broken away to show details of construction therebelow.

The bottom wall shown generally at 22 is illustrated in FIGS. 4 and 5.

An outer bottom wall 70 is provided, preferably flat on the lower face, comprising a plurality of longitudinally disposed extruded plank sections 71, 72, 73 with longitudinal tongue and groove joints 74 at their meeting face portions and welded along the joints 74 and which can be secured to inwardly extending ribs 75 on the bottom side rails 32.

Connecting each pair of opposite wall posts 25 a transverse floor beam 76 of I cross section is provided with brackets 77 at each end secured to the upright flanges of the bottom side rails 32.

The plank sections 71, 72 and 73 at their intersection with the floor beams 76 can be welded to the floor beams 76.

An inner bottom wall 80 is provided, preferably flat on its upper face, comprising a plurality of longitudinally disposed extruded plank sections 81, 82 and 83, with longitudinal joints 84, preferably hooked to restrain separation of the plank sections 81, 82 and 83. Inwardly extending ribs 85 are provided on the bottom side rails 32, the plank sections 81, 82 and 83 also resting on the transverse beams 76. The plank sections 81, 82 and 83 can be secured to the ribs 85 and to the beams 76 in any desired manner.

It will be noted that the insert castings 60 can be removed for replacement by drilling out the pop rivets 64 and 67, new castings 60 inserted if required and the structure reriveted.

Similarly, if the wear blocks 43 require replacement, access to the brackets 38 can readily be had by drilling out the pop rivets 51, 52 and 53 and removing the upper casting 50. The nuts 41 and bolts 40 can be removed and the bracket 38 removed and replaced by another bracket 38 with its wear blocks 43, secured as before, and the upper casting 50 replaced and re-riveted.

We claim:

1. In an air cargo container having a plurality of enclosing walls including a bottom wall with fork lift receiving openings on at least one side, the improvement which comprises protective means for said openings having fork lift tongue impact resistant upright outer wall portions extending outwardly from said openings to protect said container, said protective means comprises a lower casting through which one of said openings extends, said lower casting is fixedly mounted on said container, and an upper casting is mounted above said lower casting and is detachably secured to a portion of the container.

2. The combination defined in claim 1 in which said upper casting is detachably secured to said lower casting.

3. The combination defined in claim 2 in which a bracket is provided interiorly of said lower casting and detachably secured to a portion of said container.

4. The combination defined in claim 3 in which said bracket has side wall portions provided with wear blocks.

5. The combination defined in claim 4 in which said bracket is accessible upon removal of said upper casting.

* * * * *